US007774128B2

(12) United States Patent
Kim

(10) Patent No.: US 7,774,128 B2
(45) Date of Patent: Aug. 10, 2010

(54) METHOD FOR MEASURING INITIAL HYDROCARBON CONCENTRATION IN CANISTER AND CONTROLLING FUEL INJECTION THEREBY, AND SYSTEM THEREOF

(75) Inventor: Hyung Kee Kim, Gunpo (KR)

(73) Assignee: Hyundai Motor Company, Seoul (KR)

( * ) Notice: Subject to any disclaimer, the term of this patent is extended or adjusted under 35 U.S.C. 154(b) by 311 days.

(21) Appl. No.: 11/957,177

(22) Filed: Dec. 14, 2007

(65) Prior Publication Data

US 2009/0070005 A1 Mar. 12, 2009

(30) Foreign Application Priority Data

Sep. 6, 2007 (KR) ..... 10-2007-0090660

(51) Int. Cl.
*F02M 33/04* (2006.01)

(52) U.S. Cl. ..... 701/109; 701/114; 73/114.39; 123/325; 123/698; 123/520

(58) Field of Classification Search ..... 123/325, 123/518–520, 698; 73/114.39; 701/109, 701/114

See application file for complete search history.

(56) References Cited

U.S. PATENT DOCUMENTS 6,119,662 A * 9/2000 Duty et al. ..... 123/520
6,932,068 B2 * 8/2005 Osanai ..... 123/674
6,971,375 B2 * 12/2005 Amano et al. ..... 123/520
7,013,215 B2 * 3/2006 Armstrong et al. ..... 701/114
7,219,660 B2 * 5/2007 Amano et al. ..... 123/520
2003/0084892 A1 * 5/2003 Ohkuma ..... 123/688
2005/0193997 A1 * 9/2005 Cullen et al. ..... 123/698
2005/0274368 A1 * 12/2005 Itakura et al. ..... 123/698
2007/0186915 A1 * 8/2007 Annoura ..... 123/698

FOREIGN PATENT DOCUMENTS

KR 10-2007-0006898 1/2007

* cited by examiner

*Primary Examiner*—Erick Solis
(74) *Attorney, Agent, or Firm*—Morgan, Lewis & Bockius LLP

(57) ABSTRACT

A method of measuring an initial hydrocarbon concentration in a canister includes opening a purge control valve thereby introducing hydrocarbons from the canister to a cylinder; calculating an amount of air introduced into the cylinder; and calculating the initial hydrocarbon concentration based on the amount of air. A method of controlling fuel injection includes measuring an initial hydrocarbon concentration in a canister by opening a purge control valve in a fuel cut-off mode; determining a driving state of a vehicle; calculating an air inflow to a cylinder according to the driving state of the vehicle; calculating a λ set-point according to the driving state of the vehicle; and calculating fuel injection amount based on the air inflow and the λ set-point. Also, a system for controlling fuel injection.

21 Claims, 4 Drawing Sheets

METHOD FOR MEASURING INITIAL HYDROCARBON CONCENTRATION IN CANISTER AND CONTROLLING FUEL INJECTION THEREBY, AND SYSTEM THEREOF

CROSS-REFERENCE TO RELATED APPLICATION

This application claims priority to and the benefit of, Korean Patent Application No. 10-2007-0090660, filed in the Korean Intellectual Property Office on Sep. 6, 2007, the entire contents of which are incorporated herein by reference.

BACKGROUND OF THE INVENTION (a) Field of the Invention

The present invention relates to a method and system for measuring an initial hydrocarbon concentration in a canister, and for controlling vehicle fuel injection.

(b) Description of the Related Art

The automotive industry has actively sought to reduce pollutants in exhaust gases. One method for reducing pollutants in exhaust gases is by using canister purge.

Generally, gasoline in a fuel tank includes a mixture of hydrocarbons ranging from higher volatility butanes (C4) to lower volatility C8 to C10 hydrocarbons. When the temperature of the surroundings is high or vapor pressure in the fuel tank is increased by movement of the gasoline, fuel vapor leaks through crevices in the fuel tank. To prevent this leakage, the fuel vapor is vented into a canister.

The canister has absorbent material for absorbing the fuel vapor. If the hydrocarbons HC absorbed by the canister were vented into the atmosphere, the engine would not meet exhaust gas regulations. Therefore, an engine control unit operates a purge control solenoid valve in order to vent the hydrocarbons from the canister into the engine. In order to precisely control air and fuel amounts supplied to the engine, it is very important to measure the hydrocarbon concentration in the canister.

The above information disclosed in this Background section is only for enhancement of understanding of the background of the invention and therefore it may contain information that does not form the prior art that is already known in this country to a person of ordinary skill in the art.

SUMMARY OF THE INVENTION

A method of measuring an initial hydrocarbon concentration in a canister includes opening a purge control valve, thereby introducing hydrocarbons from the canister to a cylinder; calculating an amount of air introduced into the cylinder; and calculating the initial hydrocarbon concentration based on the amount of air.

A method of controlling fuel injection includes measuring an initial hydrocarbon concentration in a canister by opening a purge control valve in a fuel cut-off mode; determining a driving state of a vehicle; calculating an air inflow to a cylinder according to the driving state of the vehicle; calculating a λ set-point according to the driving state of the vehicle; and calculating fuel injection amount based on the air inflow and the λ set-point.

A system for controlling fuel injection is also disclosed.

The purge control valve may be closed after calculating the initial hydrocarbon concentration.

The opening of the purge control valve may only be performed only if the driving state of a vehicle is a fuel cut-off mode, characterized by: a vehicle speed is larger than a predetermined vehicle speed, a throttle valve is closed, an engine speed is larger than a predetermined speed, and the purge control valve is closed.

The amount of air M_air may be calculated by $M_air=E_s \cdot IMP-E_o$, where $E_s$ indicates an efficiency slope, IMP indicates an intake manifold pressure, and $E_o$ indicates an efficiency offset.

The efficiency slope and the efficiency offset may be determined based on engine speed, atmospheric pressure, intake temperature, exhaust pressure, and valve timing.

The initial hydrocarbon concentration N_HC may be calculated by $N_HC=M_air/\lambda$, where M_air indicates the amount of air and λ indicates an oxygen amount in an exhaust gas.

DETAILED DESCRIPTION OF PREFERRED EMBODIMENTS

Hereinafter, exemplary embodiments of the present invention will be described in detail with reference to the accompanying drawings.

Figure 1:
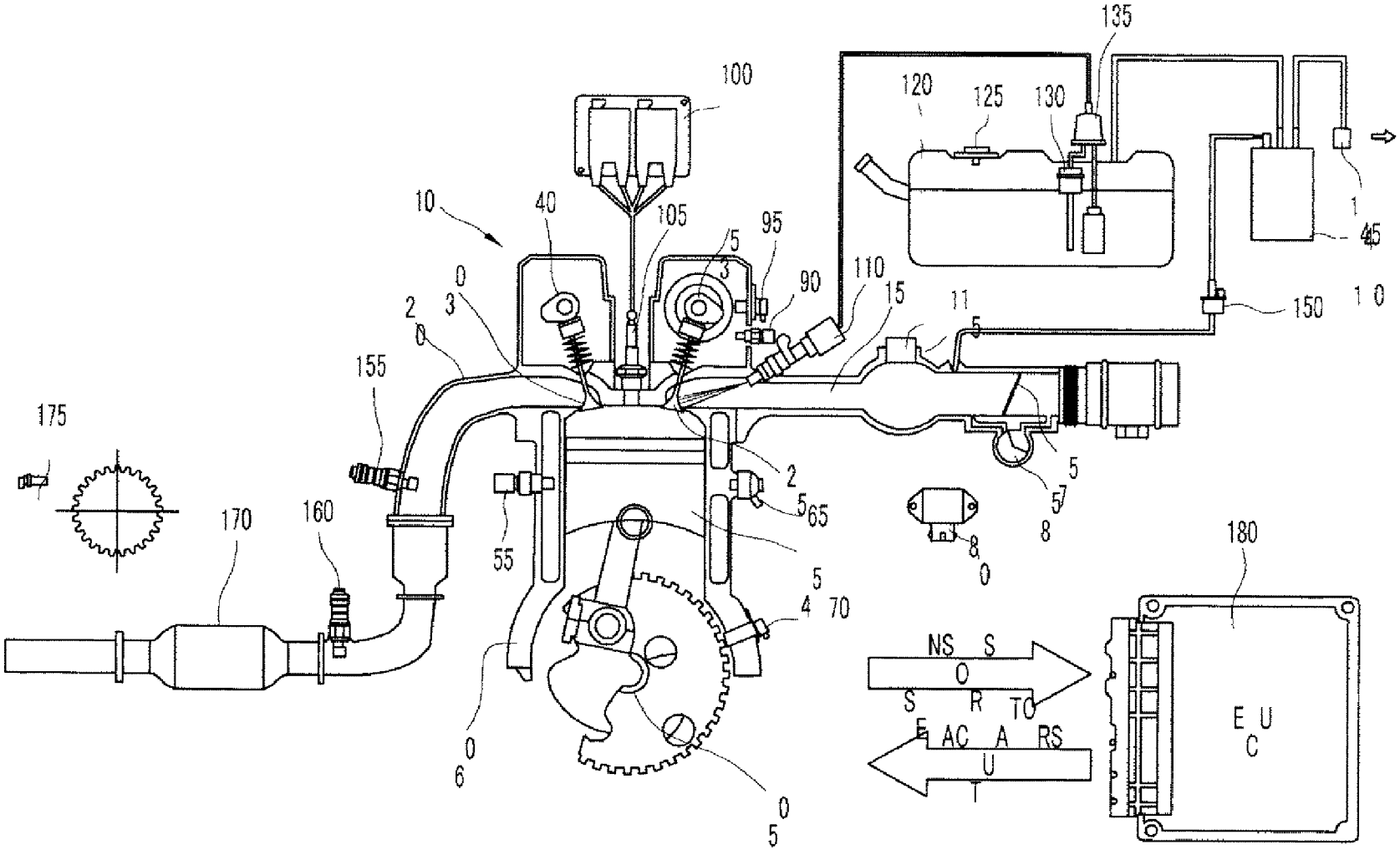
FIG. 1 is a schematic diagram of an engine according to an exemplary embodiment of the present invention.

As shown in FIG. 1, an engine 10 according to an exemplary embodiment of the present invention includes a cylinder 60, an intake pipe 15, an exhaust pipe 20, a fuel tank 120, a canister 140, a purge control solenoid valve 150, and an engine control unit (ECU) 180.

The cylinder 60 is provided with a cylinder head and a cylinder block, and a piston 45 and a crankshaft 50 are mounted in the cylinder 60. The piston 45 moves reciprocally by a force of the fuel combustion and rotates the crankshaft 50.

The intake pipe 15 and the exhaust pipe 20 are connected to the cylinder head of the cylinder 60, and the intake pipe 15 and the exhaust pipe 20 are closed or opened by an intake valve 25 and an exhaust valve 30, respectively. In addition, the intake valve 25 and the exhaust valve 30 are driven by an intake cam 35 and an exhaust cam 40, respectively. The intake cam 35 and the exhaust cam 40 are connected to and controlled by a valve timing control unit (not shown).

A throttle valve 75, which controls air inflow amount to the engine 10 based on the amount of depression of an accelerator pedal, and a speed actuator 85, which controls an idle air amount in order to maintain idle speed of the engine 10, is mounted in the intake pipe 15. In addition, an injector 110 is mounted to the intake pipe 15 and injects fuel vapor stored in the fuel tank 120 into the cylinder 60.

A throttle opening sensor 80 and a manifold pressure sensor 115 are mounted to the intake pipe 15. The throttle opening sensor 80 detects an opening of the throttle valve 75, and transmits a signal corresponding thereto to the engine control unit 180. The manifold pressure sensor 115 detects intake pressure of air flowing through the idle speed actuator 85 and the throttle valve 75 and transmits a signal corresponding thereto to the engine control unit 180. The engine control unit 180 calculates an air inflow amount to the engine 10 based on the intake pressure of air detected by the manifold pressure sensor 115.

A catalytic converter is mounted to the exhaust pipe 20 and filters noxious material in the exhaust gas. First and second oxygen sensors 155 and 160 are mounted to the exhaust pipe 20. The first oxygen sensor 155 may be a linear O2 sensor.

The first oxygen sensor 155 is mounted to a front portion of the exhaust pipe 20, and the second oxygen sensor 160 is mounted to a rear portion of the exhaust pipe 20. The first and second oxygen sensors 155 and 160 detect an oxygen amount in the exhaust gas and transmit signals corresponding thereto to the engine control unit 180.

A spark plug 105 operated by an ignition coil 100 is mounted to the cylinder head. In addition, an oil temperature sensor 90 and a camshaft position sensor 95 are mounted to the cylinder head. The oil temperature sensor 90 detects temperature of oil in the cylinder head and transmits a signal corresponding thereto to the engine control unit 180. The camshaft position sensor 95 detects a phase angle of a camshaft and transmits a signal corresponding thereto to the engine control unit 180.

A coolant pathway is provided in the cylinder block. In addition, a coolant sensor 55, a knock sensor 65, and a crankshaft position sensor 70 are mounted to the cylinder block. The coolant sensor 55 detects the temperature of the coolant flowing through the coolant pathway and transmits a signal corresponding thereto to the engine control unit 180. The knock sensor 65 detects vibrations of the cylinder block and occurrence of knocking, and transmits a signal corresponding thereto to the engine control unit 180. The engine control unit 180 delays ignition timing or increases an air-fuel ratio so as to prevent knocking. The crankshaft position sensor 70 detects a phase angle of the crankshaft 50, calculates engine RPM thereby, and transmits a signal corresponding thereto to the engine control unit 180.

In addition, a vehicle speed sensor 175 is mounted to a wheel of the vehicle. The vehicle speed sensor 175 detects vehicle speed and transmits a signal corresponding thereto to the engine control unit 180.

In addition to the above described sensors, other sensors may be mounted to the vehicle.

The fuel is stored in the fuel tank 120. The fuel tank 120 is provided with a tank pressure sensor 125 for detecting pressure in the fuel tank 120, a hydraulic fuel pump 135, and a pressure regulator 130 for controlling oil pressure in an oil line. The fuel tank 120 is connected to the injector 110 and supplies the fuel to the engine. In addition, the fuel tank 120 is connected to the canister 140 and exhausts fuel vapor to the canister 140 when vapor pressure in the fuel tank 120 increases.

The canister 140 has absorbent material for absorbing the fuel vapor from the fuel tank 120. In addition, the canister 140 is connected to the intake pipe 15 via a purge control solenoid valve 150, and is connected to the atmosphere through a canister valve 145. The purge control solenoid valve 150 vents the hydrocarbons in the canister 140 to the engine 10, and the canister valve 145 generates negative pressure in the canister 140 in order to aid absorption of the fuel vapor.

The purge control solenoid valve 150 is duty controlled according to a hydrocarbon supply time and the hydrocarbon concentration calculated by the engine control unit 180 when the engine 10 operates. The engine control unit 180 closes the purge control solenoid valve 150 such that the hydrocarbons are not excessively vented to the engine 10 when the purge process is not needed in the canister 140.

The engine control unit 180 may include one or more processors programmed to perform the inventive method. The engine control unit 180 may also include a memory and associated hardware, software, and/or firmware as may be selected and programmed by a person of ordinary skill in the art based on the teachings herein.

The engine control unit 180 is electrically connected to the above-described sensors and receives the signals therefrom. In addition, the engine control unit 180 is electrically connected to the valves, the actuator, and the regulator, and controls operation of the same.

Figure 2:
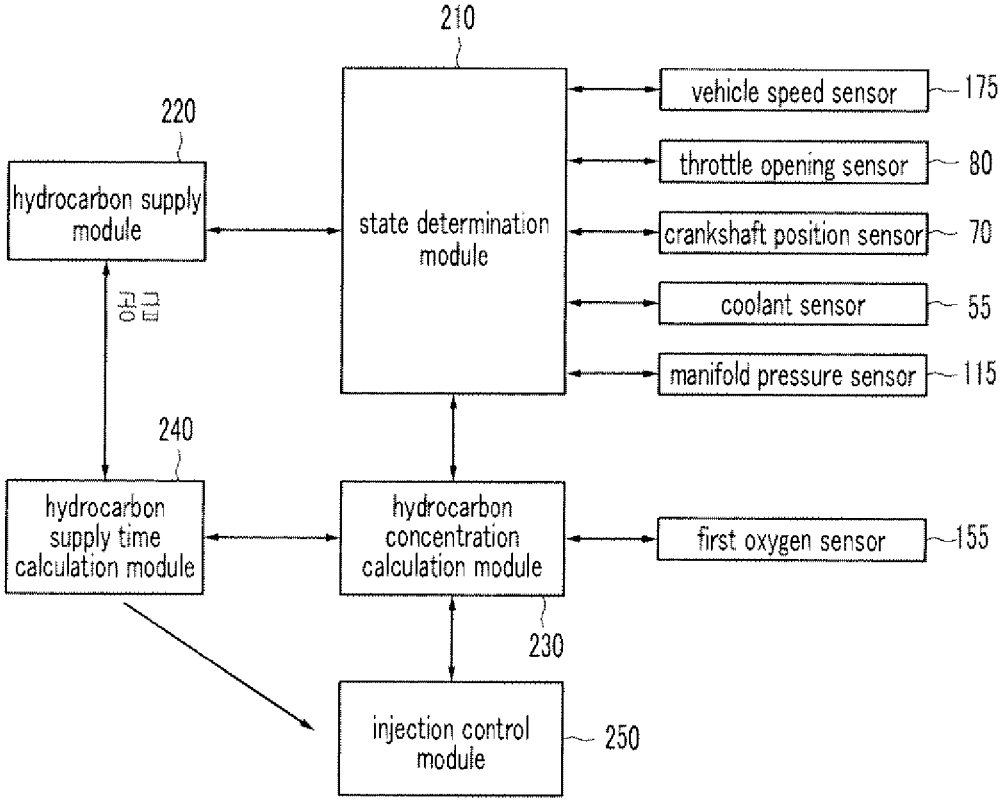
FIG. 2 is a block diagram of a system for controlling fuel injection according to an exemplary embodiment of the present invention.

Referring to FIG. 2, a system for controlling fuel injection by using an initial hydrocarbon concentration in a canister according to an exemplary embodiment of the present invention includes a state determination module 210, a hydrocarbon supply module 220, a hydrocarbon concentration calculation module 230, a hydrocarbon supply time calculation module 240, and an injection control module 250.

The state determination module 210 is electrically connected to, and receives the signals from, the vehicle speed sensor 175, the throttle opening sensor 80, the crankshaft position sensor 70, the coolant sensor 55, and the manifold pressure sensor 115.

In addition, the state determination module 210 determines a driving state of the vehicle based on the signals transmitted from the sensors. The driving state of the vehicle may be, for example, a fuel cut-off mode, a steady mode, or a canister purge inhibition mode, but may be selected by a person of ordinary skill in the art based on the teachings herein.

The fuel cut-off mode is a state when the vehicle speed is larger than a specific speed and the fuel is not injected to the cylinder, i.e. the vehicle speed is larger than a predetermined vehicle speed, the throttle valve is closed, the engine RPM is larger than a predetermined RPM, and the purge control solenoid valve is closed. The predetermined vehicle speed and predetermined RPM can be selected by a person of an ordinary skill in the art based on the teachings herein. For example, the predetermined vehicle speed nay be 10 km/h, and the predetermined RPM may be 1000 rpm.

The steady mode is a state when the vehicle is driven normally, i.e. the current state is a part load state or an idle state, an air change amount $\Delta M_air$ is smaller than a predetermined air change amount, the current state of the vehicle is not the fuel cut-off mode, the current state is not a quick acceleration state nor a quick deceleration state, and coolant temperature is higher than a predetermined temperature. The predetermined air change amount and the predetermined temperature can be selected by a person of an ordinary skill in the art based on the teachings herein. For example, the predetermined air change amount may be 30%, and the predetermined temperature may be 60° C.

The driving state of the vehicle is the canister purge inhibition mode when the driving state of the vehicle is not the fuel cut-off mode of the steady mode. The hydrocarbon supply module 200 is not operated in the canister purge inhibition mode.

In addition, the state determination module 210 transmits a signal corresponding to the driving state of the vehicle to the hydrocarbon supply module 220, the hydrocarbon concentration calculation module 230, the hydrocarbon supply time calculation module 240, and the injection control module 250.

The hydrocarbon supply module 220 supplies the hydrocarbons in the canister 140 to the engine 10 according to the driving state of the vehicle determined by the state determination module 210. The hydrocarbon supply module 220 includes the purge control solenoid valve 150.

The hydrocarbon supply module 220 supplies the hydrocarbons from the canister 140 to the engine 10 in either of two cases:

First, when the driving state of the vehicle is the fuel cut-off mode, the hydrocarbon supply module 220 forcibly opens the purge control solenoid valve 150 and forcibly supplies the hydrocarbons from the canister 140 to the engine 10. In this case, the hydrocarbon concentration calculation module 230 calculates the initial hydrocarbon concentration in the canister 140.

Second, when the driving state of the vehicle is the steady mode and the initial hydrocarbon concentration in the canister 140 is higher than a predetermined concentration, the hydrocarbon supply module 220 supplies the hydrocarbons from the canister 140 to the engine 10. In this case, the hydrocarbon supply module 220 performs the purge process in the canister 140 by supplying the hydrocarbons to the engine 10. The predetermined concentration may be selected by a person of ordinary skill in the art based on the teachings herein, and may be, for example, 10%.

The hydrocarbon concentration calculation module 230 is connected to the first oxygen sensor 155 and receives the signal corresponding to the oxygen amount in the exhaust gas. In addition, the hydrocarbon concentration calculation module 230 calculates the air inflow to the cylinder 60 and the initial hydrocarbon concentration in the canister 140 based on values measured by the sensors and the oxygen amount in the exhaust gas.

The air inflow to the cylinder 60 is calculated in all modes, but the initial hydrocarbon concentration in the canister 140 is calculated only when the purge control solenoid valve 150 is opened and the hydrocarbons of the canister 140 are forcibly supplied to the engine 10 in the fuel cut-off mode. This is because the fuel is not injected in the fuel cut-off mode, and thus the hydrocarbon concentration in the canister 140 can be calculated without disturbance.

A method of calculating the air inflow to the cylinder 60 and the initial hydrocarbon concentration in the canister 140 will be described below.

The hydrocarbon supply time calculation module 240 calculates the hydrocarbon supply time T when the driving state of the vehicle is the steady mode, the initial hydrocarbon concentration in the canister 140 is higher than the predetermined concentration (i.e., a purge process is needed in the canister). In this case, the hydrocarbon supply module 220 is operated during the hydrocarbon supply time T and forcibly supplies the hydrocarbons from the canister 140 to the engine 10.

A method for calculating the hydrocarbon supply time T will also be described below.

The injection control module 250 calculates a fuel injection amount according to the driving state of the vehicle determined by the state determination module 210 and the air inflow to the cylinder 60, and the initial hydrocarbon concentration in the canister 140 calculated by the hydrocarbon concentration calculation module 230. The injection control module 250 includes an injection control valve (not shown) and the injector 110.

Hereinafter, referring to FIG. 3 and FIG. 5, a method for measuring an initial hydrocarbon concentration in a canister according to an exemplary embodiment of the present invention will be described in detail.

Figure 3:
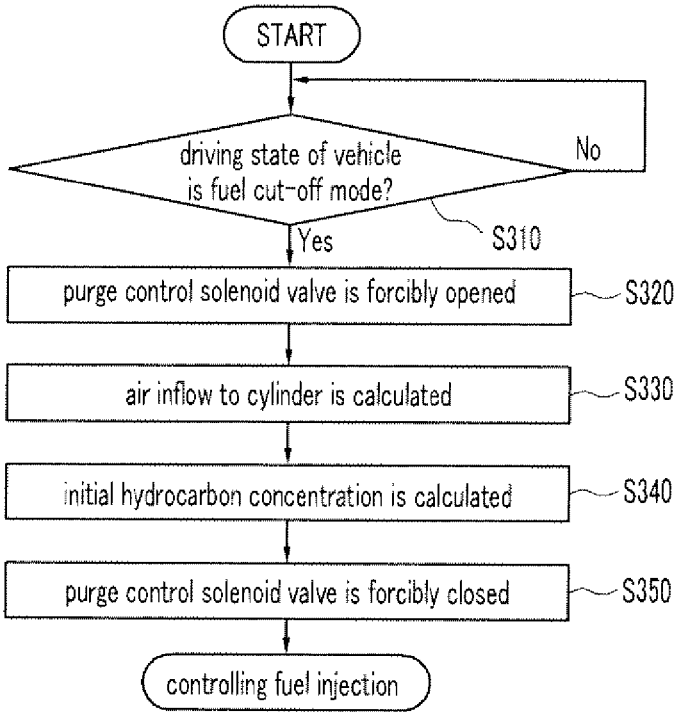
FIG. 3 is a flowchart of a method of measuring an initial hydrocarbon concentration in a canister according to an exemplary embodiment of the present invention.

As shown in FIG. 3, when the vehicle begins its operation, the state determination module 210 determines, based on the values measured by the sensors, whether the driving state of the vehicle is the fuel cut-off mode at step S310.

If the driving state of the vehicle is not the fuel cut-off mode at step S310, the state determination module 210 continues to check the driving state of the vehicle.

If the driving state of the vehicle is the fuel cut-off mode at step S310, the state determination module 210 operates the hydrocarbon supply module 220. That is, the purge control solenoid valve (PCSV) 150 is forcibly opened at step S320, and the hydrocarbons from the canister 140 are forcibly supplied to the engine 10. In this case, the hydrocarbon concentration calculation module 230 calculates the air inflow M_air to the cylinder based on the intake manifold pressure IMP at step S330.

Figure 5:
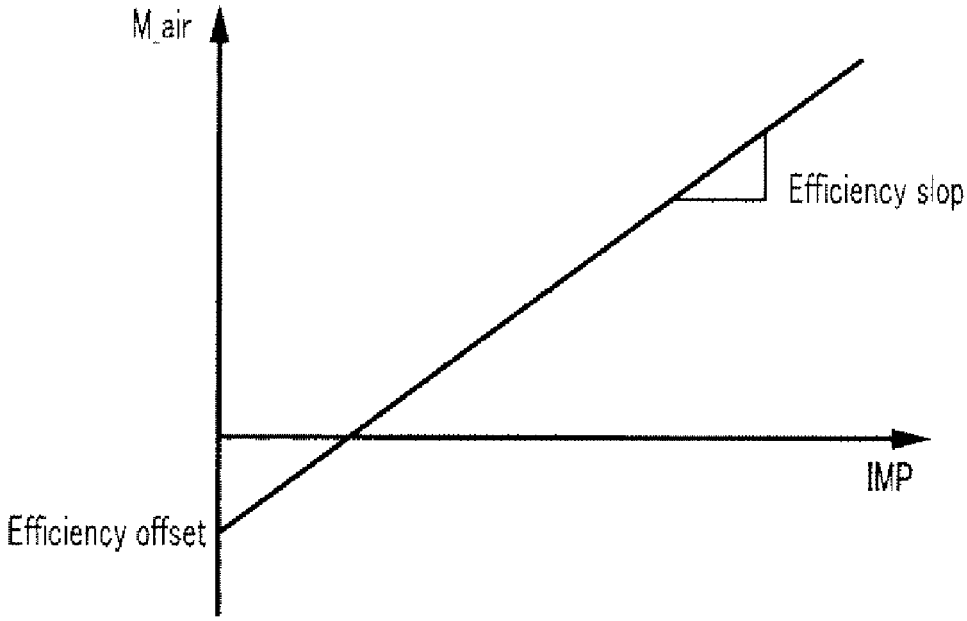
FIG. 5 is a graph plotting air inflow to a cylinder against intake manifold pressure in an engine according to exemplary embodiments of the present invention.

As shown in FIG. 5, the air inflow M_air to the cylinder is linearly related to the intake manifold pressure IMP. Therefore, if the manifold pressure sensor 115 detects the intake manifold pressure IMP, the air inflow M_air to the cylinder is calculated from Equation 1.

$$M_air = E_s \cdot IMP - E_o \quad \text{[Equation 1]}$$

where $E_s$ indicates efficiency slope and $E_o$ indicates efficiency offset.

The efficiency slope and the efficiency offset are determined according to the engine RPM, the atmospheric pressure, the intake temperature, the exhaust pressure, and the valve timing, and are stored in a map table.

After that, the hydrocarbon concentration calculation module 230 calculates the initial hydrocarbon concentration N_HC in the canister 140 based on the air inflow M_air to the cylinder and the oxygen concentration λ in the exhaust gas at step S340.

The initial hydrocarbon concentration N_HC in the canister 140 is inversely related to the oxygen concentration λ in the exhaust gas. Therefore, if the first oxygen sensor 155 detects the oxygen concentration λ in the exhaust gas, normalized hydrocarbon concentration N_HC is calculated from Equation 2.

$$N_HC = \frac{M_air}{\lambda} \quad \text{[Equation 2]}$$

The initial hydrocarbon concentration N_HC in the canister 140 is stored in the injection control module 250.

After that, the hydrocarbon supply module 220 forcibly closes the purge control solenoid valve 150 at step S350, and the injection control module 250 begins control of the fuel injection.

Figure 6:
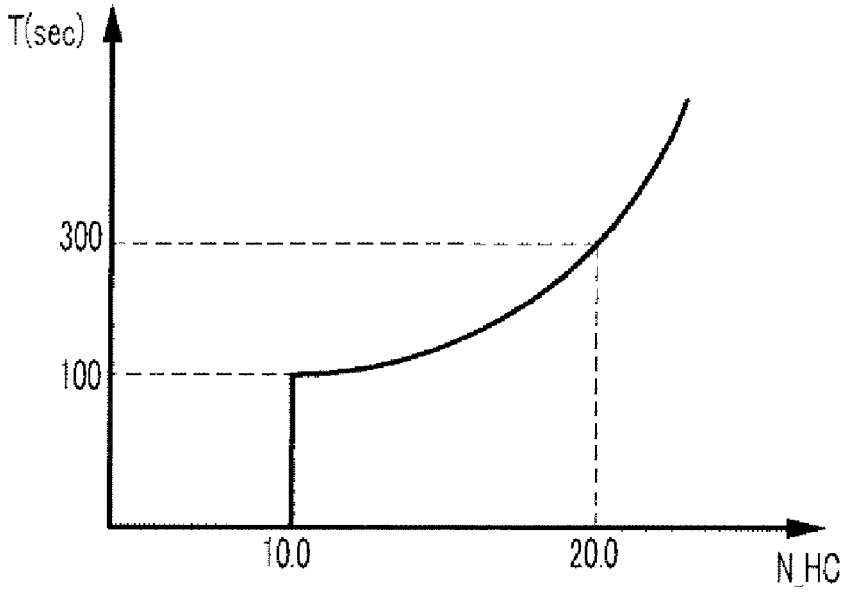
FIG. 6 is a graph plotting a hydrocarbon supply time against an initial hydrocarbon concentration according to exemplary embodiments of the present invention.

Hereinafter, referring to FIG. 4 to FIG. 6, a method for controlling fuel injection by using an initial hydrocarbon concentration in a canister according to an exemplary embodiment of the present invention will be described in detail.

Figure 4:
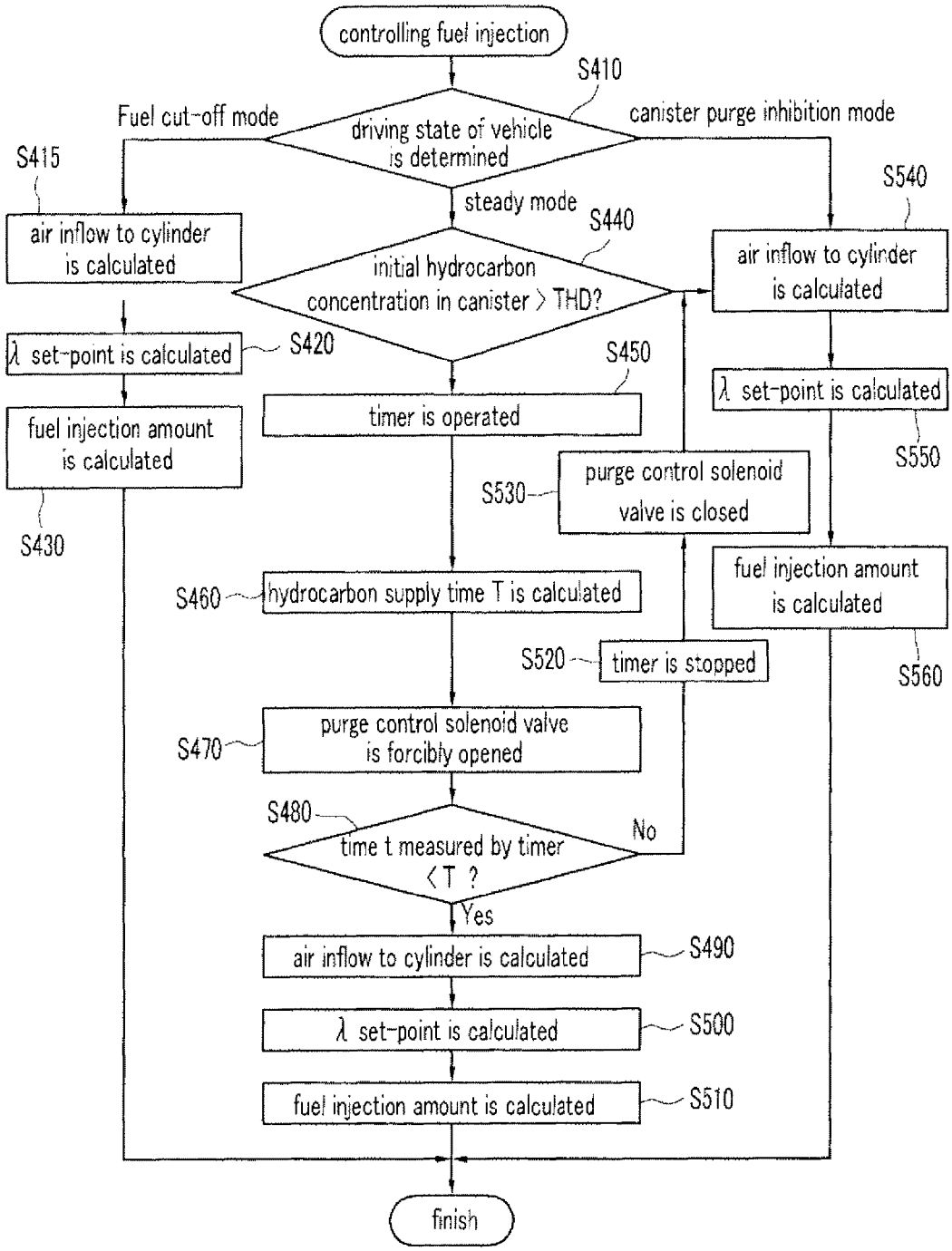
FIG. 4 is a flowchart of a method of controlling fuel injection according to an exemplary embodiment of the present invention.

As shown in FIG. 4, after the purge control solenoid valve 150 is forcibly opened and the initial hydrocarbon concentration in the canister 140 is measured in the fuel cut-off mode, the state determination module 210 determines the driving state of the vehicle according to the values measured by the sensors at step S410. As described above, the driving state of the vehicle is defined as the fuel cut-off mode, the steady mode, or the canister purge inhibition mode according to an exemplary embodiment of the present invention. Therefore, the method for controlling the fuel injection in these driving states of the vehicle will be described.

If the driving state of the vehicle is determined as the fuel cut-off mode at step S410, the hydrocarbon concentration calculation module 230 calculates the air inflow to the cylinder at step S415 by Equation 1. After that, the injection control module 250 calculates a λ set-point at step S420. The reason for setting the λ set-point is as follows.

If the hydrocarbon concentration in the canister 140 is heavy, fuel concentration in the cylinder 60 is lean and imperfect combustion may occur. Therefore, the λ set-point is set such that the fuel concentration in the cylinder 70 is rich according to the oxygen concentration λ in the exhaust gas, and then perfect combustion may occur when the hydrocarbon is supplied to the engine 10. Accordingly, the exhaust gas may be reduced. The λ set-point LSP is calculated from Equation 3.

$$LSP = \frac{1}{\lambda - 1} \quad \text{[Equation 3]}$$

After that, the injection control module 250 calculates the fuel injection amount M_fuel from Equation 4 at step S430 and controls the fuel injection according to the calculated fuel injection amount.

$$M_\text{fuel} = K \cdot M_\text{air} \cdot LSP \quad \text{[Equation 4]}$$

If the driving state of the vehicle is determined as the steady mode at step S410, it is determined at step S440 whether the initial hydrocarbon concentration in the canister 140 is larger than the predetermined concentration THD. The predetermined concentration THD may be selected by a person of ordinary skill in the art based on the teachings herein. For example, the predetermined concentration THD may be 10%.

If the initial hydrocarbon concentration in the canister 140 is smaller than or equal to the predetermined concentration at step S440, the state determination module 210 determines that the driving state of the vehicle is the canister purge inhibition mode, since the purge process in the canister 140 is not needed.

If the initial hydrocarbon concentration in the canister 140 is larger than the predetermined concentration THD at step S440, the hydrocarbon supply time calculation module 240 operates a timer at step S450 and calculates the hydrocarbon supply time T at step S460. That is, in the case that the initial hydrocarbon concentration in the canister 140 is larger than the predetermined concentration THD, the hydrocarbon supply time T during which the purge control solenoid valve 150 is forcibly opened is calculated since the purge process in the canister 140 is needed. As shown in FIG. 6, the hydrocarbon supply time T is a quadratic function of the initial hydrocarbon concentration N_HC in the canister. Such hydrocarbon supply time T can be selected by a person of an ordinary skill in the art based on the teachings herein.

After that, the hydrocarbon supply module 220 forcibly opens the purge control solenoid valve 150 at step S470, and the hydrocarbon supply time calculation module 240 determines whether a time t measured by the timer is smaller than the hydrocarbon supply time T at step S480.

If the time t measured by the timer is smaller than the hydrocarbon supply time T at the step S480, the hydrocarbon concentration calculation module 230 calculates the air inflow M_air to the cylinder from Equation 1 at step S490, and the injection control module 250 calculates the λ set-point LSP at step S500. The λ set-point LSP is 1 in the steady mode.

After that, the injection control module 250 calculates the fuel injection amount from Equation 4 at step S510, and controls the fuel injection according to the calculated fuel injection amount.

If the time t measured by the timer is larger than or equal to the hydrocarbon supply time T at the step S480, the hydrocarbon supply time calculation module 240 stops the timer at step S520, and the hydrocarbon supply module 220 closes the purge control solenoid valve 150 at step S530. After that, the state determination module 210 determines that the driving state of the vehicle is the canister purge inhibition mode, and controls the fuel injection amount according to the canister purge inhibition mode.

If the driving state of the vehicle is determined as the canister purge inhibition mode at step S410, the hydrocarbon concentration calculation module 230 calculates the air inflow to the cylinder from Equation 1 at step S540, and the injection control module 250 calculates the λ set-point LSP at step S550. The λ set-point LSP is 1 in the canister purge inhibition mode.

After that, the injection control module 250 calculates the fuel injection amount from Equation 4 at step S560 and controls the fuel injection according to the calculated fuel injection amount.

According to the present invention, since an initial hydrocarbon concentration in a canister is precisely measured, the fuel amount supplied to an engine through an injector may be precisely calculated and thus exhaust gas may be reduced.

In addition, since the hydrocarbons absorbed in the canister can be supplied to the engine at the required amount and time, the canister may be maintained as its maximum state and thus exhaust of fuel vapor may be reduced.

In addition, since the canister purge time is precisely calculated and hydrocarbon concentration absorbed in the canister is controlled to be lean, a bad smell of the fuel may be reduced and drivability in the purge process may be enhanced.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A method of measuring an initial hydrocarbon concentration in a canister, comprising:

opening a purge control valve, thereby introducing hydrocarbons from the canister to a cylinder;

calculating an amount of air introduced into the cylinder; and calculating the initial hydrocarbon concentration based on the amount of air, wherein calculating the amount of air M_air comprises $$M_\text{air} = E_s \cdot IMP - E_o,$$

where $E_s$ indicates an efficiency slope, IMP indicates an intake manifold pressure, and $E_o$ indicates an efficiency offset.

2. The method of claim 1, further comprising closing the purge control valve after calculating the initial hydrocarbon concentration.

3. The method of claim 1, wherein the opening of the purge control valve is performed only if a driving state of a vehicle is a fuel cut-off mode, the fuel cut-off mode comprising: a vehicle speed is larger than a predetermined vehicle speed, a throttle valve is closed, an engine speed is larger than a predetermined speed, and the purge control valve is closed.

4. The method of claim 1, wherein the efficiency slope and the efficiency offset are determined based on an engine speed, an atmospheric pressure, an intake temperature, an exhaust pressure, and valve timing.

5. The method of claim 1, wherein calculating the initial hydrocarbon concentration N_HC comprises $$N_HC = M_air/\lambda,$$

wherein M_air indicates the amount of air and λ indicates an oxygen amount in an exhaust gas.

6. A method of controlling fuel injection, comprising:

measuring an initial hydrocarbon concentration in a canister by opening a purge control valve in a fuel cut-off mode;

determining a driving state of a vehicle;

calculating an air inflow to a cylinder according to the driving state of the vehicle;

calculating a λ set-point according to the driving state of the vehicle; and calculating fuel injection amount based on the air inflow and the λ set-point, wherein calculating the air inflow M_air comprises $$M_air = E_s \cdot IMP - E_o,$$

wherein $E_s$ indicates an efficiency slope, $E_o$ indicates an efficiency offset, and IMP indicates an intake manifold pressure.

7. The method of claim 6, wherein the driving state of the vehicle is defined as:

a fuel cut-off mode in which a vehicle speed is larger than a predetermined vehicle speed, a throttle valve is closed, an engine speed is larger than a predetermined speed, and the purge control valve is closed;

a steady mode in which a current state is a part load state or an idle state, an air change amount is smaller than a predetermined air change amount, a current driving state of the vehicle is not the fuel cut-off mode, the current state is not a quick acceleration state or a quick deceleration state, and a coolant temperature is higher than a predetermined temperature; or a canister purge inhibition mode.

8. The method of claim 6, wherein calculating the fuel injection amount M_fuel comprises $$M_fuel = K \cdot M_air \cdot LSP,$$

wherein K indicates an injector constant, M_air indicates the air inflow, and LSP indicates the λ set-point.

9. The method of claim 7, wherein calculating the λ set-point LSP comprises $LSP = 1/(\lambda - 1)$ if the driving state of the vehicle is the fuel cut-off mode, wherein λ indicates an oxygen concentration in an exhaust gas.

10. The method of claim 7, wherein the λ set-point LSP is 1 if the driving state of the vehicle is the steady mode or the canister purge inhibition mode.

11. The method of claim 7, further comprising:

determining whether the initial hydrocarbon concentration in the canister is larger than a predetermined concentration if the driving state of the vehicle is the steady mode; and opening the purge control valve during a hydrocarbon supply time T if the initial hydrocarbon concentration in the canister is larger than the predetermined concentration.

12. The method of claim 11, wherein the hydrocarbon supply time T comprises a quadratic function of the initial hydrocarbon concentration in the canister.

13. A system for controlling fuel injection, comprising:

a state determination module electrically connected to one or more sensors and determining a driving state of a vehicle;

a hydrocarbon supply module supplying hydrocarbons from a canister according to the driving state of the vehicle;

a hydrocarbon concentration calculation module calculating an air inflow to a cylinder and an initial hydrocarbon concentration in the canister based on values measured by the sensors and an oxygen concentration in an exhaust gas; and an injection control module controlling fuel injection according to the driving state of the vehicle, the air inflow, and the initial hydrocarbon concentration, wherein calculating the initial hydrocarbon concentration N_HC in the canister comprises $$N_HC = M_air/\lambda,$$

wherein M_air indicates the air inflow and λ indicates the oxygen concentration in the exhaust gas.

14. The system of claim 13, wherein the one or more sensors comprises a member selected from the group consisting of a vehicle speed sensor, a throttle opening sensor, a crankshaft position sensor, a coolant sensor, a manifold pressure sensor, an oxygen sensor, and combinations thereof.

15. The system of claim 13, wherein the hydrocarbon supply module supplies hydrocarbons from the canister to an engine, and the hydrocarbon concentration calculation module calculates the initial hydrocarbon concentration in the canister when the driving state of the vehicle is a fuel cut-off mode.

16. The system of claim 15, wherein the driving state of the vehicle is the fuel cut-off mode if a vehicle speed is larger than a predetermined vehicle speed, a throttle valve is closed, an engine speed is larger than a predetermined speed, and the hydrocarbon supply module does not operate.

17. The system of claim 13, wherein calculating the air inflow M_air to the cylinder comprises $$M_air = E_s \cdot IMP - E_o,$$

wherein IMP indicates an intake manifold pressure, $E_s$ indicates an efficiency slope, and $E_o$ indicates an efficiency offset.

18. The system of claim 13, further comprising a hydrocarbon supply time calculation module that calculates a hydrocarbon supply time according to the driving state of the vehicle, wherein the hydrocarbon supply module is operated during the hydrocarbon supply time.

19. The system of claim 18, wherein the hydrocarbon supply time calculation module is operated only when the driving state of the vehicle is a steady mode and the initial hydrocarbon concentration in the canister is higher than a predetermined concentration.

20. The system of claim 19, wherein the driving state of the vehicle is the steady mode when a current state is a part load state or an idle state; an air change amount is smaller than a predetermined air change amount; the current driving state of the vehicle is not a fuel cut-off mode, a quick acceleration state, or a quick deceleration state; and a coolant temperature is higher than a predetermined temperature.

21. The system of claim 18, wherein the hydrocarbon supply time T comprises a quadratic function of the initial hydrocarbon concentration in the canister.

* * * * *